US007300489B2

(12) United States Patent
Schade et al.

(10) Patent No.: US 7,300,489 B2
(45) Date of Patent: Nov. 27, 2007

(54) POWDER METALLURGICAL COMPOSITIONS AND PARTS MADE THEREFROM

(75) Inventors: Christopher T. Schade, Marlton, NJ (US); Denis Christopherson, Jr., Waupun, WI (US); Robert Causton, Delran, NJ (US)

(73) Assignee: Hoeganaes Corporation, Cinnaminson, NJ (US)

( * ) Notice: Subject to any disclaimer, the term of this patent is extended or adjusted under 35 U.S.C. 154(b) by 0 days.

(21) Appl. No.: 10/864,964

(22) Filed: Jun. 10, 2004

(65) Prior Publication Data

US 2005/0274223 A1 Dec. 15, 2005

(51) Int. Cl.
*B22F 1/00* (2006.01)

(52) U.S. Cl. ..... 75/252

(58) Field of Classification Search ..... 75/252
See application file for complete search history.

(56) References Cited

U.S. PATENT DOCUMENTS

| | | | | |
|---|---|---|---|---|
| 2,887,392 | A * | 2/1959 | Lolley | 106/38.3 |
| 4,251,274 | A * | 2/1981 | Koehler et al. | 75/252 |
| 4,483,905 | A | 11/1984 | Engstrom | 428/570 |
| 4,642,298 | A | 2/1987 | Kuramoto et al. | 501/96 |
| 4,834,800 | A | 5/1989 | Semel | 106/403 |
| 4,915,740 | A * | 4/1990 | Sakai et al. | 106/692 |
| 5,069,714 | A | 12/1991 | Gosselin | 75/252 |
| 5,108,493 | A | 4/1992 | Causton | 75/255 |
| 5,290,336 | A | 3/1994 | Luk | 75/231 |
| 5,298,055 | A | 3/1994 | Semel et al. | 75/252 |
| 5,330,792 | A | 7/1994 | Johnson et al. | 427/217 |
| 5,368,630 | A | 11/1994 | Luk | 75/252 |
| 5,498,276 | A | 3/1996 | Luk | 75/252 |
| 6,264,718 | B1 * | 7/2001 | Akagi et al. | 75/246 |
| 6,409,964 | B1 * | 6/2002 | Aota et al. | 419/19 |
| 6,648,941 | B2 * | 11/2003 | Uenosono et al. | 75/252 |

FOREIGN PATENT DOCUMENTS

| | | |
|---|---|---|
| JP | 09-279204 | * 10/1997 |
| JP | 10-287953 | 10/1998 |
| WO | WO 99/20689 | 4/1999 |

* cited by examiner

*Primary Examiner*—Roy King
*Assistant Examiner*—Ngoclan T. Mai
(74) *Attorney, Agent, or Firm*—Woodcock Washburn

(57) ABSTRACT

Metallurgical powder compositions are provided that include calcium aluminate additives, i.e., calcium aluminate or calcium aluminate containing powders, to enhance the machinability and durability of compacted and sintered parts made therefrom. The compositions generally contain a metal-based powder, such as for example, an iron-based or nickel-based powder, that constitutes the major portion of the composition. Calcium aluminate additives are combined with the metal based powder by, for example, admixing or bonding. Optionally, common alloying powders, lubricants, binding agents, and other powder metallurgy additives can be combined with the metallurgical powder composition. The metallurgical powder composition is used by compacting it in a die cavity to produce a "green" compact that may then be sintered, preferably at relatively high temperatures.

37 Claims, 4 Drawing Sheets

POWDER METALLURGICAL COMPOSITIONS AND PARTS MADE THEREFROM

FIELD OF THE INVENTION

This invention relates to metal-based, metallurgical powder compositions, and more particularly, to powder compositions that include machining aids for enhancing the machinability and wear characteristics of resultant compacted parts.

BACKGROUND OF THE INVENTION

Iron-based particles have long been used as a base material in the manufacture of structural components by powder metallurgical methods. The iron-based particles are first molded in a die under high pressures to produce a desired shape. After the molding step, the compacted or "green" component usually undergoes a sintering step to impart the necessary strength to the component.

The strength of compacted and sintered components can be increased by the addition of certain metallurgical additives, e.g., alloying elements, usually in powder form. Similarly, the machinability of sintered parts, and consequently tool durability, can be improved with the addition of metallurgical additives.

Unfortunately, metallurgical additives may also impart undesired properties to metallurgical compositions. For example, manufacturers sometimes desire to limit the amount of copper and/or nickel used in compacted metallurgical parts due to the environmental and/or recycling regulations that control the use or disposal of those parts.

Addition of metallurgical additives should not impair a compacted part's mechanical properties, such as for example, ductility, or compressibility. For example, copper and nickel-containing powder metallurgy parts often suffer from low ductility and thus pose certain design constraints when selecting metallurgical additives. Similarly, manganese sulfide often lowers the compressibility of metallurgical powders due to its low density.

A compacted part's dimensional stability during sintering may also be affected by metallurgical additives that burn out of compositions during sintering. In some applications, for example, additions of sulfur have been shown to reduce the ultimate tensile strength and elongation and increase the dimensions of sintered parts.

The cost associated with utilizing metallurgical additives can add up to a significant portion of the overall cost of the powder composition. Therefore, it has always been of interest in the powder metallurgical industry to try to develop less costly metallurgical additives to reduce and/or replace entirely commonly used alloying elements. Accordingly, there exists a current and long felt need in the powder metallurgical industry to develop alternatives to the use of, or decrease the amount of, various common metallurgical additives in metallurgical powder compositions.

SUMMARY OF THE INVENTION

The present invention provides metallurgical powder compositions comprising as a major component a powder metallurgy metal-based powder combined with a calcium aluminate additive. The calcium aluminate additive has been found to enhance the machinability and durability of the final, sintered, compacted parts made from the metallurgical powder compositions.

The metallurgical powder compositions generally contain at least about 85 percent by weight of a powder metallurgy metal-based powder, such as for example, an iron-based powder or a nickel-based powder. The base metal powder may be a combination of metallurgical powders commonly known in the powder metallurgical industry.

The calcium aluminate additive is either substantially pure calcium aluminate or a calcium aluminate containing powder. The calcium aluminate additive is present in the metallurgical powder compositions in an amount to provide from about 0.05 to about 7.5 percent by weight calcium aluminate. The calcium aluminate containing powder is preferably blended with the metal based powder as a calcium aluminate powder that is at least about 90 percent pure calcium aluminate. Alternatively, the calcium aluminate additive can be bonded, e.g., with a binder or diffusion bonded, to the base metal powder.

The metallurgical powder compositions can optionally also contain any of the various other metallurgical additives commonly known in the powder metallurgical industry. For example, the compositions can contain lubricants, binding agents, and other alloying elements or powders such as, for example, copper, nickel, manganese, and graphite.

The present invention also provides methods for the preparation of these metallurgical powder compositions and also methods for forming compacted and sintered metal parts from such compositions, along with the products formed by such methods.

DETAILED DESCRIPTION OF ILLUSTRATIVE EMBODIMENTS

Figure 1:
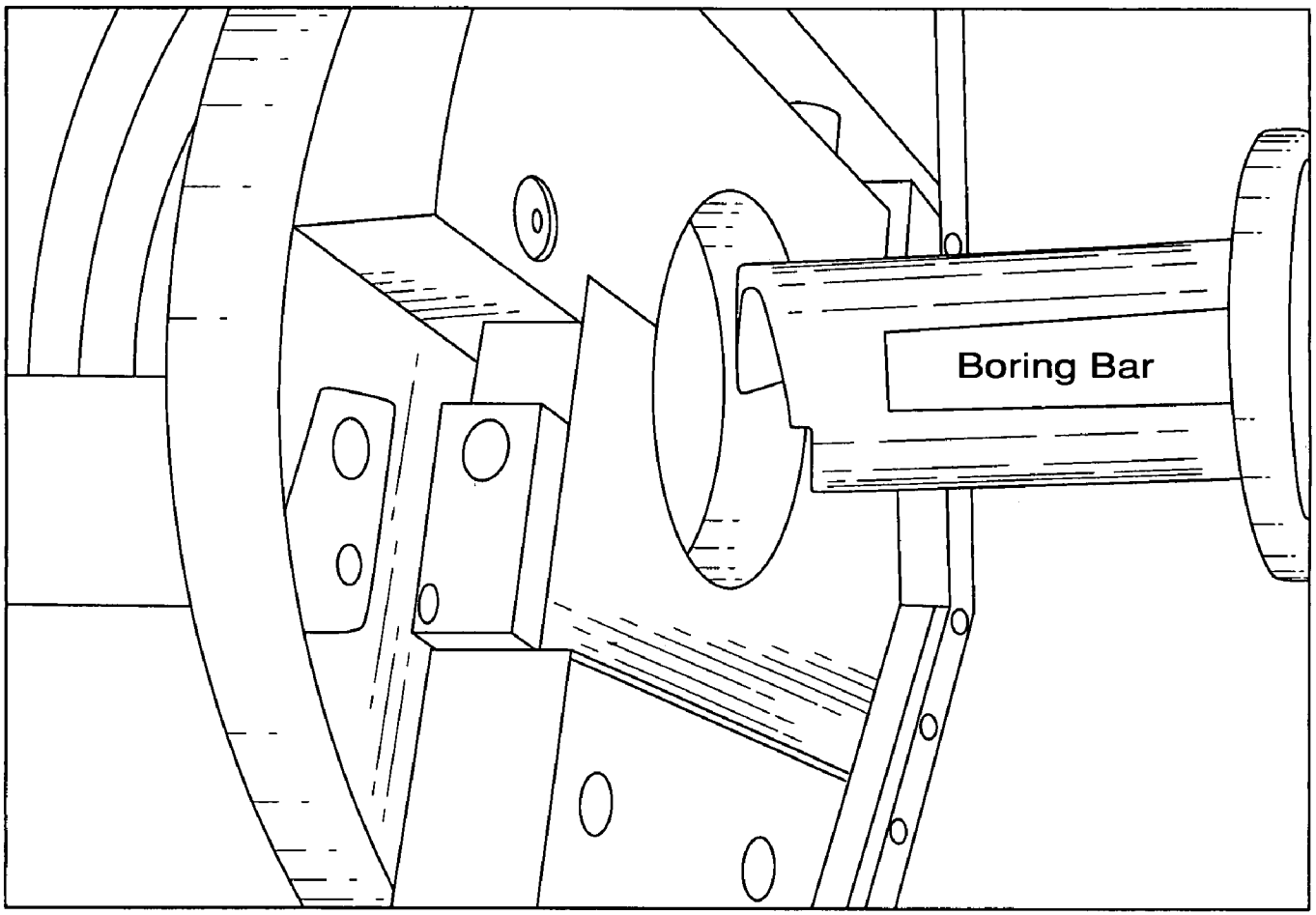
FIG. 1 is a side view of a line boring fixture for measuring tool wear.

The present invention relates to metallurgical powder compositions, compacted parts made from those metallurgical powder compositions, and methods for the preparation of those parts. The metallurgical powder compositions comprise a powder metallurgy metal-based powder, such as an iron-based or nickel-based powder, and a calcium aluminate-additive as a machinability enhancing additive. The powder compositions can also comprise minor amounts of other commonly used alloying materials. The metallurgical powder compositions can similarly be blended with known binding agents, using known techniques, to reduce segregation and/or dusting of alloying powders during transportation, storage, and use. The powder compositions can also contain other commonly used components, such as, for example, lubricants.

The metallurgical powder compositions of the present invention are comprised of one, or a blend of more than one, metal-based powder of the kind generally used in the powder metallurgy industry. For example, such metal-based powders include iron-based powders and nickel-based powders, particularly such powders prepared by atomization techniques. Preferably, the base metal powder is an iron-based powder.

These metal powders constitute a major portion of the metallurgical powder composition, and generally constitute at least about 85 weight percent, preferably at least about 90 weight percent, and more preferably at least about 95 weight percent of the metallurgical powder composition. Preferably, this base metal powder is an atomized powder. The metal-based powder can be a mix of an atomized iron powder and a sponge iron, or other type of iron powder. Advantageously, however, the base metal powder contains at least 50 weight percent, preferably at least 75 weight percent, more preferably at least 90 weight percent, and most preferably about 100 weight percent, of an atomized iron based powder.

Examples of "iron-based" powders, as that term is used herein, are powders of substantially pure iron, powders of iron pre-alloyed with other elements (for example, steel-producing elements) that enhance the strength, hardenability, electromagnetic properties, or other desirable properties of the final product, and powders of iron to which such other elements have been diffusion bonded. Substantially pure iron powders that can be used in the invention are powders of iron containing not more than about 1.0% by weight, preferably no more than about 0.5% by weight, of normal impurities. These substantially pure iron powders are preferably atomized powders prepared by atomization techniques. Examples of such highly compressible, metallurgical-grade iron powders are the ANCORSTEEL 1000 series of pure iron powders, e.g. 1000, 1000B, and 1000C, available from Hoeganaes Corporation, Riverton, N.J. For example, ANCORSTEEL 1000 iron powder, has a typical screen profile of about 22% by weight of the particles below a No. 325 sieve (U.S. series) and about 10% by weight of the particles larger than a No. 100 sieve with the remainder between these two sizes (trace amounts larger than No. 60 sieve). The ANCORSTEEL 1000 powder has an apparent density of from about 2.85-3.00 g/cm3, typically 2.94 g/cm3. Other substantially pure iron powders that can be used in the invention are typical sponge iron powders, such as Hoeganaes' ANCOR MH-100 powder.

Metal-based powders can incorporate one or more alloying elements that enhance the mechanical or other properties of the final metal part. Alloying elements can be added in particulate form or pre-alloyed into metal-based powders. As used herein, "alloying powders" refers to materials that are capable of diffusing into iron-based or nickel-based materials upon sintering.

The alloying powders that can be admixed with metal-based powders are those known in the metallurgical powder field to enhance the strength, hardenability, electromagnetic properties, or other desirable properties of the final sintered product. Steel-producing elements are among the best known of these materials. Specific examples of alloying materials include, but are not limited to elemental molybdenum, manganese, chromium, silicon, copper, nickel, tin, gold, vanadium, columbium (niobium), metallurgical carbon (graphite), phosphorus, aluminum, sulfur, and combinations thereof. Other suitable alloying materials are binary alloys of copper with tin or phosphorus; ferro-alloys of iron with manganese, chromium, boron, phosphorus, or silicon; low-melting ternary and quaternary eutectics of carbon and two or three of iron, vanadium, manganese, chromium, and molybdenum; carbides of tungsten or silicon; silicon nitride; and sulfides of manganese or molybdenum. Pre-alloyed iron powders that incorporate such alloying elements are available from Hoeganaes Corp. as part of its ANCORSTEEL line of powders.

In some embodiments, the particle size of metal based powders and alloying powders can be relatively low. At these lower particle size ranges, the particle size distribution is preferably analyzed by laser light scattering technology as opposed to screening techniques using, for example, a MicroTrac II Instrument made by Leeds and Northrup, Horsham, Pa. Laser light scattering technology reports the particle size distribution in dx values, where it is said that "x" percent by volume of the powder has a diameter below the reported value.

Alloying powders are in the form of particles that are generally of finer size than the particles of metal powder with which they are admixed. The alloying particles generally have a particle size distribution such that they have a d90 value of below about 100 microns, preferably below about 75 microns, and more preferably below about 50 microns; and a d50 value of below about 75 microns, preferably below about 50 microns, and more preferably below about 30 microns.

The amount of alloying powder present in the composition will depend on the properties desired of the final sintered part. Generally the amount will be minor, up to about 7.5% by weight of the total powder composition, although as much as 10-15% by weight can be present for certain specialized powders. A preferred range is typically from about 0.05 to about 5.0% by weight. In another embodiment, a suitable range for most applications is about 0.25-4.0% by weight. Particularly preferred alloying elements for use in the present invention for certain applications are copper and nickel, which can be used individually at levels of about 0.25-4% by weight, and can also be used in combination. Another preferred alloying element is carbon, added in the form of graphite.

In one embodiment, iron-based powders are powders of iron, preferably substantially pure iron, that has been pre-alloyed with one or more such elements. The pre-alloyed powders can be prepared by making a melt of iron and the desired alloying elements, and then atomizing the melt, whereby the atomized droplets form the powder upon solidification.

A further example of iron-based powders are diffusion-bonded iron-based powders which are particles of substantially pure iron that have a layer or coating of one or more other alloying elements or metals, such as steel-producing elements, diffused into their outer surfaces. A typical process for making such powders is to atomize a melt of iron and then combine this atomized powder with the alloying powders and anneal this powder mixture in a furnace. Such commercially available powders include DISTALOY 4600A diffusion bonded powder from Hoeganaes Corporation, which contains about 1.8% nickel, about 0.55% molybdenum, and about 1.6% copper, and DISTALOY 4800A diffusion bonded powder from Hoeganaes Corporation, which contains about 4.05% nickel, about 0.55% molybdenum, and about 1.6% copper.

A preferred iron-based powder is one of iron pre-alloyed with molybdenum (Mo). The powder is produced by atomizing a melt of substantially pure iron containing from about 0.5 to about 2.5 weight percent molybdenum. An example of such a powder is Hoeganaes' ANCORSTEEL 85HP steel powder, which contains about 0.85 weight percent Mo, less than about 0.4 weight percent, in total, of such other materials as manganese, chromium, silicon, copper, nickel, molybdenum or aluminum, and less than about 0.02 weight percent carbon. Other analogs include ANCORSTEEL 50HP and 150HP, which have similar compositions to the 85HP powder, except that they contain 0.5 and 1.5% molybdenum, respectively. Another example of such a powder is Hoeganaes' ANCORSTEEL 4600V steel powder, which contains about 0.5-0.6 weight percent molybdenum, about 1.5-2.0 weight percent nickel, and about 0.1-0.25 weight percent manganese, and less than about 0.02 weight percent carbon.

Another pre-alloyed iron-based powder that can be used in the invention is disclosed in U.S. Pat. No. 5,108,493, entitled "Steel Powder Admixture Having Distinct Pre-alloyed Powder of Iron Alloys," which is herein incorporated in its entirety. This steel powder composition is an admixture of two different pre-alloyed iron-based powders, one being a pre-alloy of iron with 0.5-2.5 weight percent molybdenum, the other being a pre-alloy of iron with carbon and with at least about 25 weight percent of a transition element component, wherein this component comprises at least one element selected from the group consisting of chromium, manganese, vanadium, and columbium. The admixture is in proportions that provide at least about 0.05 weight percent of the transition element component to the steel powder composition. An example of such a powder is commercially available as Hoeganaes' ANCORSTEEL 41 AB steel powder, which contains about 0.85 weight percent molybdenum, about 1 weight percent nickel, about 0.9 weight percent manganese, about 0.75 weight percent chromium, and about 0.5 weight percent carbon.

Other iron-based powders that are useful in the practice of the invention are ferromagnetic powders. An example is a powder of iron pre-alloyed with small amounts of phosphorus.

The iron-based powders that are useful in the practice of the invention also include stainless steel powders. These stainless steel powders are commercially available in various grades in the Hoeganaes ANCOR® series, such as the ANCOR® 303L, 304L, 316L, 410L, 430L, 434L, and 409Cb powders. Also, iron-based powders include tool steels made by the powder metallurgy method.

The particles of the iron-based powders, such as the substantially pure iron, diffusion bonded iron, and pre-alloyed iron, have a distribution of particle sizes. Typically, these powders are such that at least about 90% by weight of the powder sample can pass through a No. 45 sieve (U.S. series), and more preferably at least about 90% by weight of the powder sample can pass through a No. 60 sieve. These powders typically have at least about 50% by weight of the powder passing through a No. 70 sieve and retained above or larger than a No. 400 sieve, more preferably at least about 50% by weight of the powder passing through a No. 70 sieve and retained above or larger than a No. 325 sieve. Also, these powders typically have at least about 5 weight percent, more commonly at least about 10 weight percent, and generally at least about 15 weight percent of the particles passing through a No. 325 sieve. As such, these powders can have a weight average particle size as small as one micron or below, or up to about 850-1,000 microns, but generally the particles will have a weight average particle size in the range of about 10-500 microns. Preferred are iron or pre-alloyed iron particles having a maximum weight average particle size up to about 350 microns; more preferably the particles will have a weight average particle size in the range of about 25-150 microns, and most preferably 80-150 microns. Reference is made to MPIF Standard 05 for sieve analysis.

The iron-based powders can have particle size distributions, for example, in the range of having a d50 value of between about 1-50, preferably between about 1-25, more preferably between about 5-20, and even more preferably between about 10-20 microns, for use in applications requiring such low particle size powders, e.g., use in metal injection molding applications.

The metal powder used as the major component in the present invention, in addition to iron-based powders, can also include nickel-based powders. Examples of "nickel-based" powders, as that term is used herein, are powders of substantially pure nickel, and powders of nickel pre-alloyed with other elements that enhance the strength, hardenability, electromagnetic properties, or other desirable properties of the final product. The nickel-based powders can be admixed with any of the alloying powders mentioned previously with respect to the iron-based powders. Examples of nickel-based powders include those commercially available as the Hoeganaes ANCORSPRAY® powders such as the N-70/30 Cu, N-80/20, and N-20 powders. These powders have particle size distributions similar to the iron-based powders. Preferred nickel-based powders are those made by an atomization process.

Calcium aluminate additives include calcium aluminate or calcium aluminate containing additives. The calcium aluminate additives are added to or blended with either one or more of the above described metal-based powders. The addition of calcium aluminate additives has been found to increase the machinability and durability of compacted parts without a significant effect on the dimensional change of the product. Calcium aluminate additives diminish, and in some cases totally obviate, the need to use additional machinability enhancing alloying additives.

Calcium aluminate is substantially pure calcium aluminate having only a minor amount of impurities. Preferably, substantially pure calcium aluminate contains at least 99.5 weight percent calcium aluminate. Even more preferably substantially pure calcium aluminate contains at least 99.9 weight percent monocalcium aluminate powder.

Calcium aluminate containing powders are composed of, as a major component, alumina and calcia contributing minerals, such as for example, CaO (calcium oxide) and $Al_2O_3$ (alumina), that have been fused, sintered, or roasted to form monocalcium aluminate ($CaAl_2O_4$). The alumina and calcia contributing minerals produces monocalcium aluminate ($CaAl_2O_4$) clinkers that are subsequently atomized by techniques known to those skilled in the art. Calcium aluminate containing powders can also include, as minor constituents, any of a number inorganic compounds and oxides thereof that are known to those skilled in the art, such as for example, silicon oxide ($SiO_2$), $Fe_2O_3$, $TiO_2$, MgO, $K_2O$, sulfur, vanadium oxide, and combinations thereof.

Preferably, calcium aluminate containing powders are composed of at least about 65 weight percent calcium aluminate. More preferably the calcium aluminate containing powder is composed of at least about 80 weight percent calcium aluminate, and even more preferably at least about 90 weight percent calcium aluminate. In one embodiment, calcium aluminate containing powders are substantially pure calcium aluminate.

In one embodiment, calcium aluminate containing powders contain from about 30 to about 80 weight percent alumina and from about 20 to about 70 weight percent calcium oxide. Preferably, calcium aluminate containing powders contain from about 50 to about 70 weight percent alumina and from about 30 to about 50 weight percent calcium oxide. More preferably, calcium aluminate containing powders contain from about 51 to about 57 weight percent alumina and from about 31 to about 37 weight percent calcium oxide.

In another embodiment, calcium aluminate containing powders contain from about 51 to about 57 weight percent alumina, from about 31 to about 37 weight percent calcium oxide, not more than 6.0 weight percent $SiO_2$, not more than 2.5 weight percent $Fe_2O_3$, not more than 3.0 weight percent $TiO_2$, not more than 2.0 weight percent MgO, not more than 0.2 weight percent $K_2O$, and not more than 0.2 weight percent sulfur. A preferred calcium aluminate composition is Calcuim Aluminate C, available from BPI, Inc., of Pittsburgh, Pa.

The particle size of the calcium aluminate additives is generally relatively small and measured by laser light scattering technology as opposed to screening techniques. The particle size distribution of the calcium aluminate containing powder used preferably is such that it has a d90 value of below about 100 microns, more preferably below about 75 microns, and even more preferably below about 50 microns. These calcium aluminate containing powders preferably have a d50 value of below about 75 microns, more preferably below about 50 microns, and even more preferably below about 25 microns, and as low as below about 10 microns.

In another embodiment, the calcium aluminate additives can have a relatively coarser particle size distribution, such that at least about 90% by weight of the powder passes through a 100 mesh sieve, and more preferably at least about 90% by weight of the powder passes through a 200 mesh sieve. The calcium aluminate additive powder is preferably a high grade, high purity powder, having a purity level (calcium aluminate content) in excess of about 90, more preferably in excess of about 95, and even more preferably in excess of about 98 percent by weight.

It is preferred to blend the calcium aluminate additive into the metallurgical powder composition. The present invention, however, can also be practiced by first either blending, prealloying, or bonding by any means the calcium aluminate additive with any other powder component of the metallurgical powder composition. For example, the calcium aluminate additive can be first combined with another alloying powder and this combined powder can then be blended with the metal powder, e.g., an iron-based powder, to form the metallurgical composition with the addition of any other optional alloying powders, binding agents, lubricants, etc., as discussed below. In addition, the calcium aluminate additive can be bonded to the metal-based powder, such as the iron-based powder, by way of a conventional diffusion bonding process. In such a diffusion bonding process, the iron-based powder and the calcium aluminate additive are combined and subjected to temperatures of between about 800-1000° C.

Advantageous results are found when the metallurgical powder composition contain, generally, from about 0.05 to about 7.5 weight percent, and more generally from about 0.1 to about 5.0 weight percent, of calcium aluminate. Preferably, the metallurgical powder composition contains from about 0.05 to about 2.0 weight percent calcium aluminate, and more preferably from about 0.1 to about 1.0 weight percent calcium aluminate. Still more preferably the metallurgical powder compositions contain from about 0.1 to about 0.5 weight percent calcium aluminate, and even still more preferably from about 0.1 to about 0.35 weight percent calcium aluminate.

The metallurgical powder compositions can also contain a lubricant powder to reduce the ejection forces when the compacted part is removed from the compaction die cavity. Examples of such lubricants include stearate compounds, such as lithium, zinc, manganese, and calcium stearates, waxes such as ethylene bis-stearamides, polyethylene wax, and polyolefins, and mixtures of these types of lubricants. Other lubricants include those containing a polyether compound such as is described in U.S. Pat. No. 5,498,276 to Luk, and those useful at higher compaction temperatures described in U.S. Pat. No. 5,368,630 to Luk, in addition to those disclosed in U.S. Pat. No. 5,330,792 to Johnson et al., all of which are incorporated herein in their entireties by reference.

The lubricant is generally added in an amount of up to about 2.0 weight percent, preferably from about 0.1 to about 1.5 weight percent, more preferably from about 0.1 to about 1.0 weight percent, and most preferably from about 0.2 to about 0.75 weight percent, of the metallurgical powder composition.

The components of the metallurgical powder compositions of the invention can be prepared following conventional powder metallurgy techniques. Generally, the metal powder, calcium aluminate additive, and optionally the solid lubricant and additional alloying powders (along with any other used additive) are admixed together using conventional powder metallurgy techniques, such as for example with a double cone blender.

The metallurgical powder composition may also contain one or more binding agents, particularly where an additional, separate alloying powder is used, to bond the different components present in the metallurgical powder composition so as to inhibit segregation and to reduce dusting. By "bond" as used herein, it is meant any physical or chemical method that facilitates adhesion of the components of the metallurgical powder composition.

In a preferred embodiment of the present invention, bonding is carried out through the use of at least one binding agent. Binding agents that can be used in the present invention are those commonly employed in the powder metallurgical arts. For example, such binding agents include those found in U.S. Pat. No. 4,834,800 to Semel, U.S. Pat. No. 4,483,905 to Engstrom, U.S. Pat. No. 5,298,055 to Semel et. al., and in U.S. Pat. No. 5,368,630 to Luk, the disclosures of which are hereby incorporated by reference in their entireties.

Such binding agents include, for example, polyglycols such as polyethylene glycol or polypropylene glycol; glycerine; polyvinyl alcohol; homopolymers or copolymers of vinyl acetate; cellulosic ester or ether resins; methacrylate polymers or copolymers; alkyd resins; polyurethane resins; polyester resins; or combinations thereof. Other examples of binding agents that are useful are the relatively high molecular weight polyalkylene oxide-based compositions described in U.S. Pat. No. 5,298,055 to Semel et al. Useful binding agents also include the dibasic organic acid, such as azelaic acid, and one or more polar components such as polyethers (liquid or solid) and acrylic resins as disclosed in U.S. Pat. No. 5,290,336 to Luk, which is incorporated herein by reference in its entirety. The binding agents in the '336 patent to Luk can also act advantageously as a combination of binder and lubricant. Additional useful binding agents include the cellulose ester resins, hydroxy alkylcellulose resins, and thermoplastic phenolic resins described in U.S. Pat. No. 5,368,630 to Luk.

The binding agent can further be the low melting, solid polymers or waxes, e.g., a polymer or wax having a softening temperature of below 200° C. (390° F.), such as polyesters, polyethylenes, epoxies, urethanes, paraffins, ethylene bisstearamides, and cotton seed waxes, and also polyolefins with weight average molecular weights below 3,000, and hydrogenated vegetable oils that are $C_{14-24}$ alkyl moiety triglycerides and derivatives thereof, including hydrogenated derivatives, e.g. cottonseed oil, soybean oil, jojoba oil, and blends thereof, as described in WO 99/20689, published Apr. 29, 1999, which is hereby incorporated by reference in its entirety herein. These binding agents can be applied by the dry bonding techniques discussed in that application and in the general amounts set forth above for binding agents. Further binding agents that can be used in the present invention are polyvinyl pyrrolidone as disclosed in U.S. Pat. No. 5,069,714, which is incorporated herein in its entirety by reference, or tall oil esters.

The amount of binding agent present in the metallurgical powder composition depends on such factors as the density, particle size distribution and amounts of the iron-alloy powder, the iron powder and optional alloying powder in the metallurgical powder composition. Generally, the binding agent will be added in an amount of at least about 0.005 weight percent, more preferably from about 0.005 weight percent to about 2 weight percent, and most preferably from about 0.05 weight percent to about 1 weight percent, based on the total weight of the metallurgical powder composition.

Compacted parts made from metallurgical powder compositions of the present invention are formed using conventional techniques. Typically, the metallurgical powder composition is poured into a die cavity and compacted under pressure, such as between about 5 and about 200 tons per square inch (tsi), more commonly between about 10 and 100 tsi. The compacted part is then ejected from the die cavity.

Conventionally, the compacted ("green") part is then sintered to enhance its strength. Sintering is preferably conducted at a temperature of at least 2150° F. (1175° C.), more preferably at least about 2200° F. (1200° C.), still more preferably at least about 2250° F. (1230° C.), and even more preferably at least about 2300° F. (1260° C.). The sintering operation can also be conducted at lower temperatures, such as at least 2050° F. (1120° C.). The sintering is conducted for a time sufficient to achieve metallurgical bonding and alloying.

EXAMPLES

The following examples, which are not intended to be limiting, present certain embodiments and advantages of using calcium aluminate additives as a machinability enhancing additive. Unless otherwise indicated, any percentages are on a weight basis.

The machinability characteristics of metallurgical powder compositions were obtained using a computer controlled line boring test fixture shown in FIG. 1. The line boring test fixture is composed of a boring bar and a fastening element capable of holding a compacted part. The boring bar bores, i.e., drills, into the compacted part under controlled conditions to determine the amount of tool wear.

In operation, the boring bar is rotated about its axis and moved into contact with the compacted part. Rotation of the boring bar forms a recess in the compacted part. Each pass of the boring bar opens, i.e. cuts or shaves away, a recess in the compacted part by a predetermined cut depth. After a specified number of passes, the inside diameter of the recess is measured and compared to the expected value determined by the cutting conditions. The difference between the measured inside diameter and the expected inside diameter represents the amount of tool wear.

Unless otherwise disclosed herein the following examples were conducted using a boring bar composed of KC 9110 grade steel and a 0.010 cut depth. The boring bar was advanced at a rate of 0.010 inches per revolution.

Example 1

Metallurgical powder compositions composed of calcium aluminate additive were evaluated and compared to a reference powder that did not include a machinability additive and a reference powder containing a manganese sulfide additive. Reference Composition I was an iron based powder admixed with 2.0 weight percent copper and 0.8 weight percent graphite. The iron based powder was a substantially pure water atomized iron based powder. Reference Composition I is commercially available as FC-0208 from Hoeganaes Corp.

Reference Composition II was an iron based powder admixed with 2.0 weight percent copper, 0.8 weight percent graphite, 0.3 by weight manganese sulfide, and 0.75% by weight of an ethylene bis-stearamide wax lubricant (commercially available as Acrawax, from Glycol Chemical Co.). The iron based powder was a substantially pure water atomized iron based powder.

Test Composition I was an iron based powder admixed with 2.0 weight percent copper, 0.8 weight percent graphite, 0.35 weight percent calcium aluminate containing powder, and 0.75 weight percent of an ethylene bis-stearamide wax lubricant (commercially available as Acrawax, from Glycol Chemical Co.). The iron based powder was a substantially pure water atomized iron based powder. The calcium aluminate powder had a d50 value of 5 microns. The calcium aluminate powder is commercially available as "Calcium Aluminate C" from BPI, Inc. of Pittsburgh, Pa.

Each powder composition was pressed at 45 tons per square inch into bars measuring 0.25 inches high, 0.5 inches wide, and 1.5 inches long. The bars were then sintered in a 90% nitrogen and 10% hydrogen atmosphere at 2050 degrees Fahrenheit.

Figure 2:
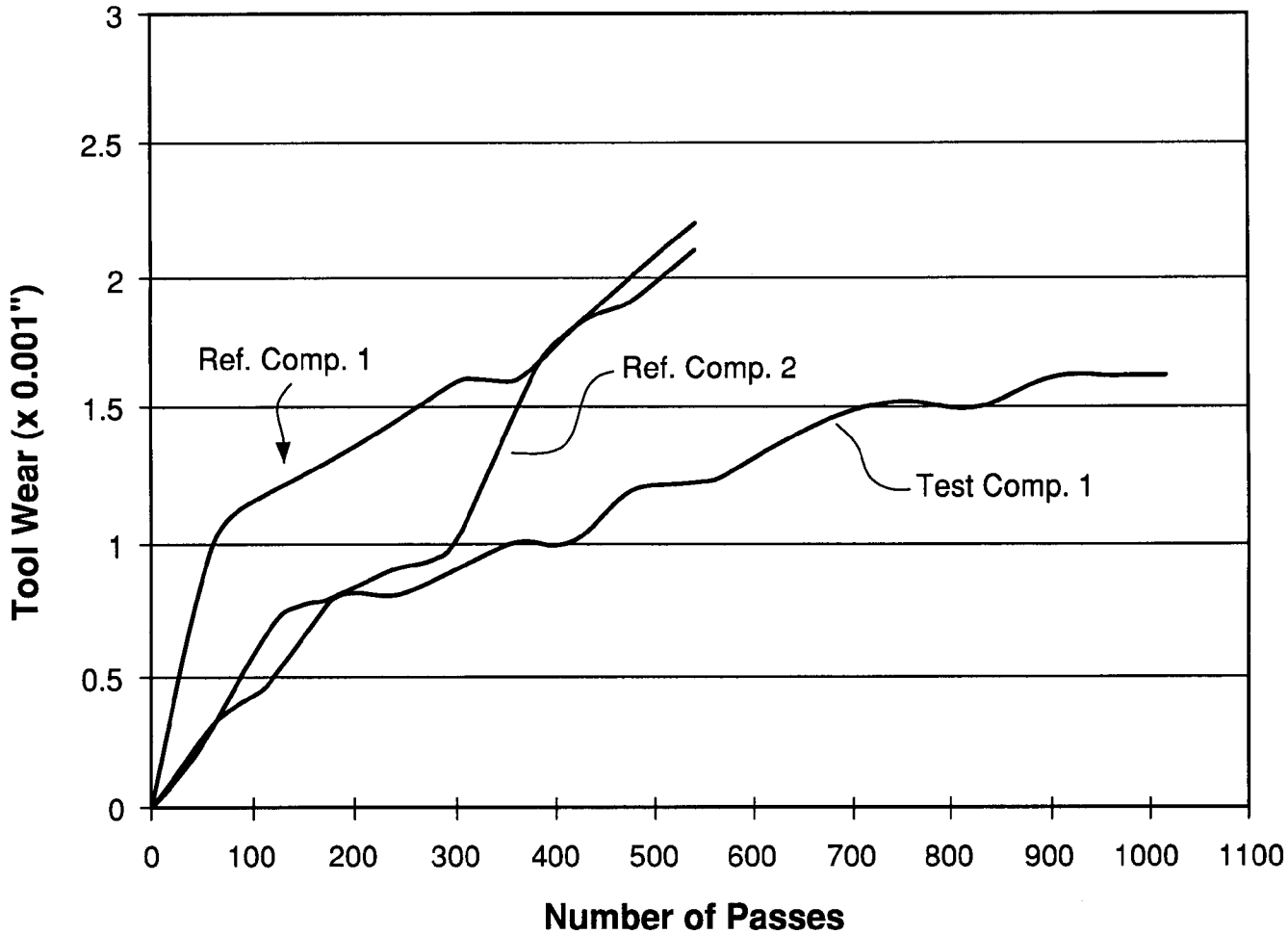
FIG. 2 is a graph showing the tool wear exhibited by parts made from metallurgical powder compositions composed of a calcium aluminate additive after being bored at a cutting speed of 400 surface feet per minute.

Sintered parts were then machined to measure the wear resulting from a number of tooling passes. Referring to FIG. 2, the wear properties of the sintered compacts were measured using a line boring fixture operating at a cutting speed of 400 surface feet per minute. The amount of tool wear for each composition is shown in Table 1:

TABLE 1

| Number of Passes | Reference Composition I (x 0.001") | Reference Composition II (x 0.001") | Test Composition I (x 0.001") |
|---|---|---|---|
| 1 | 0 | 0 | 0 |
| 60 | 1 | 0.3 | 0.3 |
| 120 | 1.2 | 0.7 | 0.5 |
| 180 | 1.4 | 0.8 | 0.8 |
| 240 | 1.4 | 0.9 | 0.8 |
| 300 | 1.6 | 1 | 0.9 |
| 360 | 1.6 | 1.5 | 1 |
| 420 | 1.8 | 1.8 | 1 |
| 480 | 1.9 | 2 | 1.2 |
| 540 | 2.1 | 2.2 | 1.2 |
| 600 | | | 1.2 |
| 660 | | | 1.4 |
| 720 | | | 1.5 |
| 780 | | | 1.5 |
| 840 | | | 1.5 |
| 900 | | | 1.6 |

TABLE 1-continued

| Number of Passes | Reference Composition I (x 0.001") | Reference Composition II (x 0.001") | Test Composition I (x 0.001") |
|---|---|---|---|
| 960 | | | 1.6 |
| 1020 | | | 1.6 |

Figure 3:
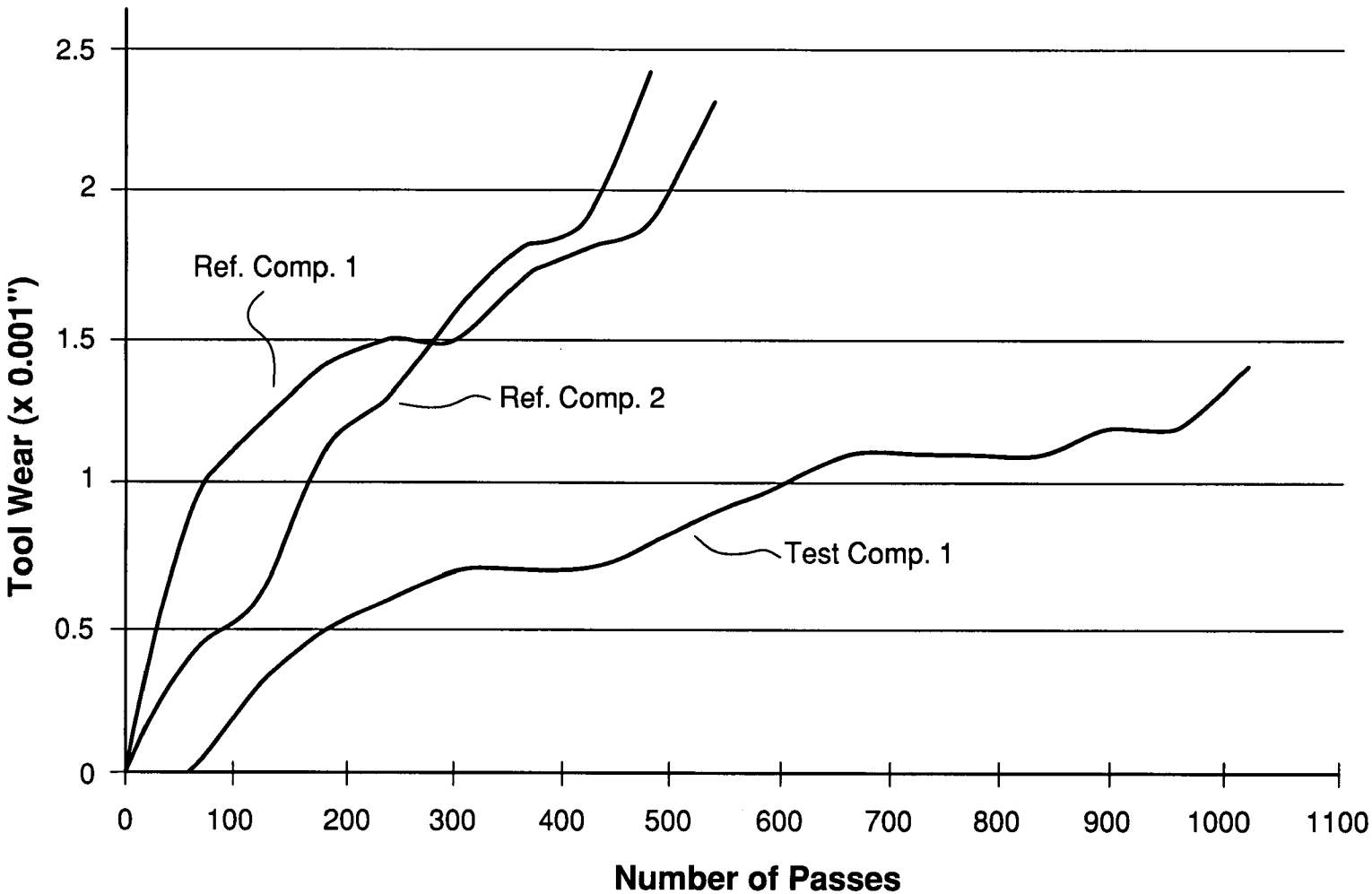
FIG. 3 is a graph showing the tool wear exhibited by parts made from metallurgical powder compositions composed of a calcium aluminate additive after being bored at a cutting speed of 600 surface feet per minute.

Referring to FIG. 3, the wear properties of the sintered compacts were measured using a line boring fixture operating at a cutting speed of 600 surface feet per minute. The amount of tool wear for each composition is shown in Table 2:

TABLE 2

| Number of Passes | Reference Composition I (x 0.001") | Reference Composition II (x 0.001") | Test Composition I (x 0.001") |
|---|---|---|---|
| 1 | 0 | 0 | 0 |
| 60 | 0.9 | 0.4 | 0 |
| 120 | 1.2 | 0.6 | 0.3 |
| 180 | 1.4 | 1.1 | 0.5 |
| 240 | 1.5 | 1.3 | 0.6 |
| 300 | 1.5 | 1.6 | 0.7 |
| 360 | 1.7 | 1.8 | 0.7 |
| 420 | 1.8 | 1.9 | 0.7 |
| 480 | 1.9 | 2.4 | 0.8 |
| 540 | 2.3 | | 0.9 |
| 600 | | | 1 |
| 660 | | | 1.1 |
| 720 | | | 1.1 |
| 780 | | | 1.1 |
| 840 | | | 1.1 |
| 900 | | | 1.2 |
| 960 | | | 1.2 |
| 1020 | | | 1.4 |

As shown in Tables 1 & 2, metallurgical powder compositions composed of calcium aluminate containing powders exhibit less tool wear compared to compositions composed of manganese sulfide powders or compositions having no machinability additive.

Example 2

Metallurgical powder compositions composed of a prealloyed metal-based powder, a copper powder, an a calcium aluminate additive were evaluated and compared to a reference powder composed of a prealloyed metal-based powder admixed with a copper powder. Reference Composition III was prepared by prealloying a substantially pure iron-based powder, 0.50 weight percent molybdenum, 1.5 weight percent manganese, and 0.85 weight percent nickel. This prealloyed powder is commercially available as Ancorsteel 737SH, from Hoeganaes Corp. The prealloyed powder was admixed with 0.8 weight percent graphite, 1.0 weight percent copper powder, and 0.75 weight percent of an ethylene bis-stearamide wax lubricant (commercially available as Acrawax from Glycol Chemical Co.). Test Composition II was the same as Reference Composition III except that it also included 0.35 weight percent calcium aluminate containing powder.

Both powder compositions were pressed at 45 tons per square inch into rings. The rings had an outside diameter of 1.75 inches, an inside diameter of 1.0 inch, and a height of 1.0 inch. The compacts were then sintered in a 90% nitrogen and 10% hydrogen atmosphere at a sintering temperatures of 2050 degrees Fahrenheit and rapidly cooled.

Figure 4:
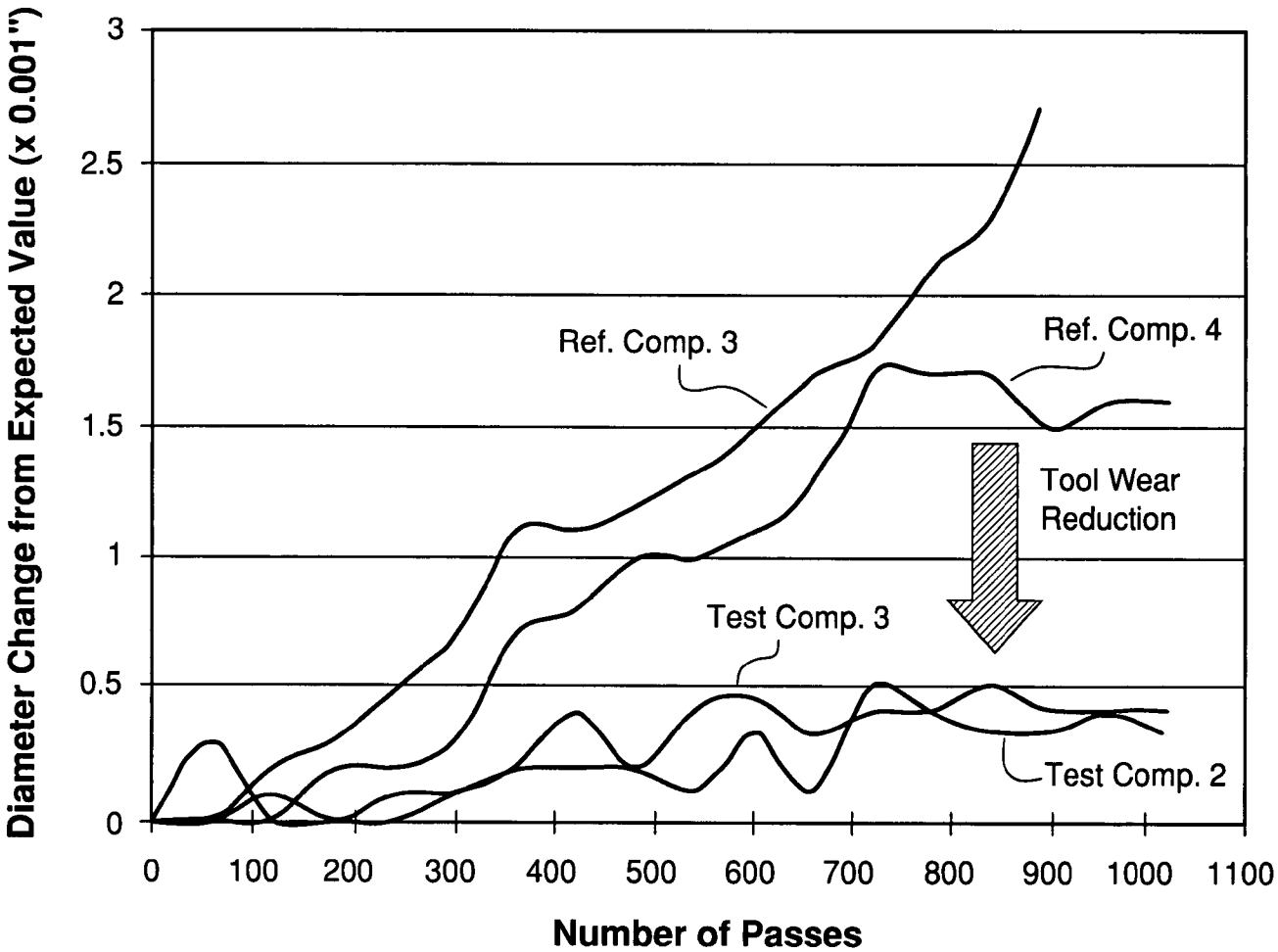
FIG. 4 is a graph showing the tool wear exhibited by parts made from metallurgical powder compositions composed of an alloying powder and a calcium aluminate additive.

Sintered parts were then machined to measure the wear resulting from a number of tooling passes. Referring to FIG. 4, the wear properties of the sintered compacts are shown in Table 3:

TABLE 3

| Number of Passes | Reference Composition III (x 0.001") | Test Composition II (x 0.001") |
|---|---|---|
| 1 | 0 | 0 |
| 60 | 0 | 0 |
| 120 | 0.2 | 0.1 |
| 180 | 0.3 | 0 |
| 240 | 0.5 | 0.1 |
| 300 | 0.7 | 0.1 |
| 360 | 1.1 | 0.2 |
| 420 | 1.1 | 0.2 |
| 480 | 1.2 | 0.2 |
| 540 | 1.3 | 0.1 |
| 600 | 1.5 | 0.3 |
| 660 | 1.7 | 0.1 |
| 720 | 1.8 | 0.5 |
| 780 | 2.1 | 0.4 |
| 840 | 2.3 | 0.3 |
| 900 | 2.8 | 0.3 |
| 960 | | 0.4 |
| 1020 | | 0.4 |

As shown in Table 3, metallurgical powder compositions composed of prealloyed powders admixed with copper powder, graphite powder, and calcium aluminate containing powder exhibit less tool wear compared to compositions composed of prealloyed powder admixed with only copper powder and graphite powder.

Example 3

Metallurgical powder compositions composed of a prealloyed metal-based powder, a graphite powder, and a calcium aluminate additive were evaluated and compared to a reference powder composed of a prealloyed metal-based powder admixed with a graphite powder. Reference Composition IV was prepared by prealloying a substantially pure iron-based powder, 0.50 weight percent molybdenum, 1.5 weight percent manganese, and 0.85 weight percent nickel. The prealloyed powder was admixed with 0.7 weight percent graphite, 1.0 weight percent copper powder, and 0.75 weight percent of an ethylene bis-stearamide wax lubricant (commercially available as Acrawax from Glycol Chemical Co.). Test Composition II was the same as Reference Composition IV except that it also included 0.35 weight percent calcium aluminate containing powder.

Both powder compositions were pressed at 45 tons per square inch into rings. The rings had an outside diameter of 1.75 inches, an inside diameter of 1.0 inch, and a height of 1.0 inch. The compacts were then sintered in a 90% nitrogen and 10% hydrogen atmosphere at a sintering temperatures of 2050 degrees Fahrenheit and rapidly cooled.

Referring to FIG. 4, the wear properties of the sintered compacts are shown in Table 4:

TABLE 4

| Number of Passes | Reference Composition IV (x 0.001") | Test Composition III (x 0.001") |
|---|---|---|
| 1 | 0 | 0 |
| 60 | 0 | 0.3 |

TABLE 4-continued

| Number of Passes | Reference Composition IV (x 0.001") | Test Composition III (x 0.001") |
|---|---|---|
| 120 | 0 | 0 |
| 180 | 0.2 | 0 |
| 240 | 0.2 | 0 |
| 300 | 0.3 | 0.1 |
| 360 | 0.7 | 0.2 |
| 420 | 0.8 | 0.4 |
| 480 | 1 | 0.2 |
| 540 | 1 | 0.4 |
| 600 | 1.1 | 0.4 |
| 660 | 1.2 | 0.3 |
| 720 | 1.7 | 0.4 |
| 780 | 1.7 | 0.4 |
| 840 | 1.7 | 0.5 |
| 900 | 1.5 | 0.4 |
| 960 | 1.6 | 0.4 |
| 1020 | 1.6 | 0.3 |

As shown in Table 4, metallurgical powder compositions composed of prealloyed powders admixed with graphite powder and calcium aluminate containing powder exhibit less tool wear compared to compositions composed of prealloyed powder admixed with only graphite powder.

There have thus been described certain preferred embodiments of metallurgical powder compositions and methods of making the same. While preferred embodiments have been disclosed and described, it will be recognized by those with skill in the art that variations and modifications are within the true spirit and scope of the invention.

What is claimed:

1. A metallurgical powder composition, comprising:

at least about 85 percent by weight of a metal-based powder; and a calcium aluminate powder comprising, as a major component, monocalcium aluminate ($CaAl_2O_4$). and having no more than 6 percent by weight, based on the weight of the calcium aluminate powder, of $SiO_2$, the calcium aluminate powder having a particle size distribution such that it has a d50 value of about 5 microns, wherein the metallurgical powder composition includes from about 0.1 to about 1.0 percent by weight of the calcium aluminate.

2. The metallurgical powder composition of claim 1 wherein the metallurgical powder composition includes from about 0.1 to about 0.35 percent by weight calcium aluminate.

3. The metallurgical powder composition of claim 1 further comprising from about 0.25 to about 4.0 percent by weight copper.

4. The metallurgical powder composition of claim 1 further comprising from about 0.25 to about 4.0 percent by weight graphite.

5. The metallurgical powder composition of claim 1 wherein the metal-based powder comprises iron-based powder.

6. The metallurgical powder composition of claim 1 wherein the metal-based powder comprises nickel-based powder.

7. The metallurgical powder composition of claim 1 wherein the metal-based powder is a prealloyed powder comprising about 0.50 weight percent molybdenum, about 1.5 weight percent manganese, and about 0.85 weight percent nickel.

8. The metallurgical powder composition of claim 1 further comprising a binder wherein the calcium aluminate powder is bonded to the base metal powder.

9. A metallurgical powder composition, comprising:

at least about 85 percent by weight of a metal-based powder; and from about 0.1 to about 1.0 percent by weight of calcium aluminate containing powder comprising:

from about 51 to about 57 weight percent alumina; and from about 31 to about 37 weight percent calcium oxide, based on the weight of the calcium aluminate containing powder.

10. The metallurgical powder composition of claim 9 wherein the calcium aluminate containing powder comprises fused alumina and calcia contributing minerals.

11. The metallurgical powder composition of claim 9 comprising from about 0.1 to about 0.35 percent by weight calcium aluminate.

12. The metallurgical powder composition of claim 9 wherein the calcium aluminate containing powder has a particle size distribution such that it has a d50 value of below about 50 microns.

13. The metallurgical powder composition of claim 9 wherein the calcium aluminate containing powder has a particle size distribution such that it has a d50 value of about 5 microns.

14. The metallurgical powder composition of claim 9 wherein the metal-based powder has a particle size distribution such that about 50 percent by weight of the metal-based powder passes through a No. 70 sieve and is retained above a No. 400 sieve.

15. The metallurgical powder composition of claim 9 further comprising from about 0.25 to about 4.0 percent by weight copper.

16. The metallurgical powder composition of claim 9 further comprising from about 0.25 to about 4.0 percent by weight graphite.

17. The metallurgical powder composition of claim 9 wherein the metal-based powder comprises iron-based powder.

18. The metallurgical powder composition of claim 9 wherein the metal-based powder comprises nickel-based powder.

19. The metallurgical powder composition of claim 9 wherein the metal-based powder is a prealloyed powder comprising about 0.50 weight percent molybdenum, about 1.5 weight percent manganese, and about 0.85 weight percent nickel.

20. The metallurgical powder composition of claim 9 further comprising a binder wherein the calcium aluminate containing powder is bonded to the base metal powder.

21. The metallurgical powder composition of claim 9 wherein the metal-based powder comprises from about 0.25 to about 4.0 weight percent molybdenum, nickel, chromium, manganese, or combination thereof.

22. The metallurgical powder composition of claim 9 wherein the metal based powder is an iron-based prealloyed powder comprising nickel, molybdenum, and manganese.

23. The metallurgical powder composition of claim 22 wherein the metal based powder further comprises a prealloyed powder comprising iron, chromium, and silicon.

24. A metallurgical powder composition, comprising:

at least about 85 percent by weight of a metal-based powder; and from about 0.1 to about 1.0 percent by weight of calcium aluminate containing powder comprising one or more components selected from the group consisting of:

less than 6.0 weight percent $SiO_2$;
less than 2.5 weight percent $Fe_2O_3$;
less than 3.0 weight percent $TiO_2$;
less than 2.0 weight percent MgO;
less than 0.2 weight percent $K_2O$, and
less than 0.2 weight percent sulfur, based on the weight of the calcium aluminate containing powder.

25. A metallurgical powder composition, comprising:
at least about 85 percent by weight of a nickel containing metal-based powder; and
a calcium aluminate containing powder comprising, as a major component, monocalcium aluminate ($CaAl_2O_4$) and having no more than 6 percent by weight, based on the weight of the calcium aluminate powder, of $SiO_2$,
wherein the metallurgical powder composition includes from about 0.05 to about 7.5 percent by weight of the calcium aluminate.

26. The metallurgical powder composition of claim 25 wherein the calcium aluminate containing powder is calcium aluminate powder.

27. The metallurgical powder composition of claim 25 wherein the nickel containing metal based powder further comprises a prealloyed powder comprising iron, chromium, and silicon.

28. The metallurgical powder composition of claim 25 wherein the nickel containing metal based powder is an iron-based prealloyed powder comprising nickel, molybdenum, and manganese.

29. The metallurgical powder composition of claim 25 wherein the metal based powder further comprises a prealloyed powder comprising iron, chromium, and silicon.

30. The metallurgical powder composition of claim 25 wherein the metal based powder is composed of:
an iron-based prealloyed powder comprising from about 0.25 to about 4.0 weight percent of a combination of nickel, molybdenum, and manganese, and
an iron based prealloyed powder comprising from about 0.25 to about 4.0 weight percent of a combination of chromium, nickel, molybdenum, manganese, and silicon.

31. A metallurgical powder composition, comprising:
at least about 85 percent by weight of a metal-based powder; and
from about 0.1 to about 1.0 percent by weight of calcium aluminate containing powder wherein the metal based powder is composed of:
an iron-based prealloyed powder comprising from about 0.25 to about 4.0 weight percent of a combination of nickel, molybdenum, and manganese, and
an iron based prealloyed powder comprising from about 0.25 to about 4.0 weight percent of a combination of chromium, nickel, molybdenum, manganese, and silicon.

32. A metallurgical powder composition, comprising:
at least about 85 percent by weight of a metal-based powder that comprises a nickel-based powder; and
a calcium aluminate powder having a particle size distribution such that it has a d50 value of about 5 microns,
wherein the metallurgical powder composition includes from about 0.1 to about 1.0 percent by weight of the calcium aluminate.

33. A metallurgical powder composition, comprising:
at least about 85 percent by weight of a pre-alloyed metal-based powder comprising about 0.50 weight percent molybdenum, about 1.5 weight percent manganese, and about 0.85 weight percent nickel; and
a calcium aluminate powder having a particle size distribution such that it has a d50 value of about 5 microns,
wherein the metallurgical powder composition includes from about 0.1 to about 1.0 percent by weight of the calcium aluminate.

34. A metallurgical powder composition, comprising:
at least about 85 percent by weight of a nickel containing metal-based powder that comprises a prealloyed powder comprising iron, chromium, and silicon; and
a calcium aluminate containing powder, wherein the metallurgical powder composition includes from about 0.05 to about 7.5 percent by weight of the calcium aluminate.

35. A metallurgical powder composition, comprising:
at least about 85 percent by weight of a metal based powder comprising a prealloyed powder comprising nickel, molybdenum, and manganese; and
a calcium aluminate containing powder,
wherein the metallurgical powder composition includes from about 0.05 to about 7.5 percent by weight of the calcium aluminate.

36. The metallurgical powder composition of claim 35 wherein the metal based powder further comprises a prealloyed powder comprising iron, chromium, and silicon.

37. A metallurgical powder composition, comprising:
at least about 85 percent by weight of a nickel containing metal-based powder that comprises (a) an iron-based prealloyed powder comprising from about 0.25 to about 4.0 weight percent of a combination of nickel, molybdenum, and manganese, and (b) an iron based prealloyed powder comprising from about 0.25 to about 4.0 weight percent of a combination of chromium, nickel, molybdenum, manganese, and silicon; and
a calcium aluminate containing powder, wherein the metallurgical powder composition includes from about 0.05 to about 7.5 percent by weight of the calcium aluminate.

* * * * *